US012510285B1

(12) United States Patent
Zhang et al.

(10) Patent No.: US 12,510,285 B1
(45) Date of Patent: Dec. 30, 2025

(54) ICE MAKING WATER DISPENSER

(71) Applicant: NINGBO AQUART ELECTRICAL APPLIANCE CO., LTD, Zhejiang (CN)

(72) Inventors: Chunyun Zhang, Zhejiang (CN); Nie Cen, Zhejiang (CN); Kaijia Chen, Zhejiang (CN)

(73) Assignee: NINGBO AQUART ELECTRICAL APPLIANCE CO., LTD, Zhejiang (CN)

( * ) Notice: Subject to any disclaimer, the term of this patent is extended or adjusted under 35 U.S.C. 154(b) by 0 days.

(21) Appl. No.: 19/240,040

(22) Filed: Jun. 17, 2025

(30) Foreign Application Priority Data

Feb. 21, 2025 (CN) ..... 202510196394.0
Mar. 25, 2025 (CN) ..... 202510353032.8

(51) Int. Cl.
*F25C 5/20* (2018.01)

(52) U.S. Cl.
CPC ..... *F25C 5/20* (2018.01); *F25C 2400/14* (2013.01)

(58) Field of Classification Search
CPC ..... F25C 5/24; F25C 5/20; F25C 2400/14; F25C 5/22; F25C 2400/04
See application file for complete search history.

(56) References Cited

U.S. PATENT DOCUMENTS 5,299,716 A * 4/1994 Hawkins ..... B67D 3/0009 D15/80
2021/0123651 A1 4/2021 Liu et al.

FOREIGN PATENT DOCUMENTS

CN 118089294 A 5/2024

OTHER PUBLICATIONS

First Office Action received in corresponding Chinese patent application No. 202510353032.8, dated Apr. 26, 2025, 12 pages.

* cited by examiner

*Primary Examiner* — Cassey D Bauer
(74) *Attorney, Agent, or Firm* — Cooper Legal Group, LLC

(57) ABSTRACT

The present application relates to an ice making water dispenser including an ice making shell in which an ice making mechanism for preparing ice blocks, an ice conveying mechanism for conveying the ice blocks and a water dispensing mechanism are disposed, the ice making shell being provided with an ice storage shell for storing the ice blocks, the ice conveying mechanism including an ice conveying screw rotatably mounted in the ice storage shell, ice conveying blades disposed on the ice conveying screw and an ice conveying driving part for driving the ice conveying screw to rotate, and the ice storage shell being provided with an ice outlet at one end of the ice conveying screw; and wherein the ice conveying mechanism is provided with baffles at the ice outlet, and conveying gaps allowing the ice blocks to pass are formed between the baffles and the ice conveying screw.

14 Claims, 8 Drawing Sheets

ICE MAKING WATER DISPENSER

CROSS REFERENCE TO RELATED APPLICATION

The present application claims the priority and benefits of Chinese patent application No. 202510196394.0, filed on Feb. 21, 2025, and Chinese patent application No. 202510353032.8, filed on Mar. 25, 2025. The entireties of Chinese patent application No. 202510196394.0 and Chinese patent application No. 202510353032.8 are hereby incorporated by reference herein and made a part of the present application.

TECHNICAL FIELD

The present application relates to a technical field of water dispensers, in particular to an ice making water dispenser.

BACKGROUND ART

An ice making water dispenser is a household appliance integrated with ice making and water dispensing functions, and aims at providing convenient and diversified water dispensing experience for users.

The ice making water dispenser generally includes an ice making system and a water dispensing system, the ice making system can rapidly make ice blocks to meet user's demands on cold drinks or iced food, and the water dispensing system supplies cold water, hot water or normal-temperature water, and a user can get water at any time according to personal preferences and demands. The ice making system includes an ice making mechanism and an ice conveying mechanism. In an existing ice making water dispenser, a screw blade mechanism is usually adopted to convey ice blocks. However, ice blocks generated by an ice maker are too large, irregular in shape and melted to be bonded, so that the ice blocks may be stuck in the ice outlet in a conveying process, which affects output of the ice blocks.

SUMMARY

The present application provides an ice making water dispenser to reduce probability that ice blocks are blocked in an ice outlet.

The present application provides an ice making water dispenser, including an ice making shell in which an ice making mechanism for preparing ice blocks, an ice conveying mechanism for conveying the ice blocks and a water dispensing mechanism are disposed, the ice making shell being provided with an ice storage shell for storing the ice blocks, the ice conveying mechanism including an ice conveying screw rotatably mounted in the ice storage shell, ice conveying blades disposed on the ice conveying screw and an ice conveying driving part for driving the ice conveying screw to rotate, the ice storage shell being provided with an ice outlet at one end of the ice conveying screw, the ice conveying mechanism being provided with baffles at the ice outlet, and conveying gaps allowing the ice blocks to pass being formed between the baffles and the ice conveying screw.

Optionally, the baffles are flexible baffles, the ice conveying mechanism includes at least two sets of the flexible baffles, and the adjacent flexible baffles are arranged in a direction perpendicular to a conveying direction of the ice blocks.

Optionally, each of the flexible baffles includes an elastic portion and a mounting portion, the ice storage shell is provided with a mounting base for mounting the flexible baffles, the mounting base is provided with a splicing through groove allowing the elastic portion to be inserted, and a limiting baffle abutting against the elastic portions is disposed on a side, provided with the splicing through groove, of the mounting base.

Optionally, the elastic portion is provided with a first cutting surfaces which is an inward concave arc surface at an end facing the ice conveying screw, and the adjacent flexible baffles have respective first cutting surfaces in inward concave directions parallel to each other.

Optionally, the mounting base is provided with two sets of guide baffles on sides, close to the ice outlet, of the flexible baffles, side walls of the two sets of guide baffles abut against two opposite side walls of the ice storage shell, and a guide gap corresponding to the ice outlet is formed between the two sets of guide baffles.

Optionally, the mounting base is provided with an ice outlet plate on a side close to the ice conveying driving part, the ice outlet plate is provided with a semicircular arc plate at bottom, the ice outlet is defined by the semicircular arc plate and a bottom wall of the ice storage shell, and the ice storage shell is rotatably mounted with an anti-cover plate for covering the ice outlet is rotatably mounted on a side distal from the flexible baffles.

Optionally, the ice conveying mechanism further includes second baffles disposed between the guide baffles and the ice outlet.

Optionally, each of the second baffle is provided with a second cutting surface, and the second cutting surface is arranged in an inward concave direction staggered with that of the first cutting surface.

Optionally, the baffles are configured as wavy baffles uniformly spaced in a conveying direction of the ice blocks and each provided with a transverse corrugated surface, and the transverse corrugated surface is provided with peaks and troughs on a side facing the ice conveying screw, and the peaks and troughs are arranged in an undulation direction perpendicular to the conveying direction of the ice blocks.

Optionally, the wavy baffles are slidably mounted on the mounting base, a sliding chute is formed in the mounting base, a driving rack is limited in the sliding chute, the ice storage shell is rotatably mounted with an anti-cover plate for covering the ice outlet is rotatably mounted on a side of the ice outlet plate distal from the baffles, the driving rack has a first end abutting against and cooperating with corresponding one of the wavy baffles, the anti-cover plate is provided with a tooth surface cooperating with a second end of the driving rack, and when the ice blocks are conveyed, the wavy baffles are driven to horizontally slide along the sliding chute, so that the driving rack actuates the anti-cover plate to pivot outwardly, thereby placing the ice outlet in an open state.

Optionally, the ice storage shell is provided with an output shell for conveying the ice blocks to outside, the output shell communicates with the ice outlet, an output through hole for allowing ice blocks to fall is formed in the output shell, and a screening and discharging mechanism is disposed in the output shell.

Optionally, the screening and discharging mechanism includes a sorting plate rotatably mounted on the output shell, sorting grid assemblies disposed on a periphery of the sorting plate and a recycling and crushing structure, wherein the sorting plate is configured as a conical turnplate, a plurality of sets of flow guide ribs arranged radially along an axis of the sorting plate are disposed on a surface of the sorting plate, the output shell is provided with first through holes allowing small ice blocks to pass between each of the sorting grid assemblies and the sorting plate, a plurality of flow guide slideways corresponding to the first through holes are disposed in the output shell, and the plurality of flow guide slideways communicate with a first pipeline for output.

Optionally, the sorting grid assemblies are circumferentially spaced along the axis of the sorting plate, each of the sorting grid assemblies includes two sorting grids arranged obliquely and has a large-opening side oriented toward the sorting plate, each of the sorting grids is disposed on the output shell by a hinge, two adjacent sorting grids of the sorting grid assemblies are connected by a telescopic rod, the sorting grids are configured to block large ice blocks, and the large ice blocks drive the sorting grids to swing outward, thereby increasing an opening size of each of the sorting grid assemblies on a side distal from the sorting plate.

Optionally, the recycling and crushing structure includes an annular conveying pipe rotatably disposed at a periphery of the sorting plate, a grinding roller set disposed on a first end of the annular conveying pipe and a second pipeline disposed on a second end of the annular conveying pipe, wherein the annular conveying pipe is provided with a second through hole corresponding to the second pipeline at the first end and a third through hole corresponding to the grinding roller set at the second end, and the grinding roller set communicates with the first pipeline; and wherein the annular conveying pipe has two operational modes: when the annular conveying pipe is inclined downward away from the ice outlet, the annular conveying pipe aligns with the second pipeline, and the large ice blocks are obliquely conveyed to the second pipeline through the sorting grid assemblies; and when the annular conveying pipe is inclined downward close to the ice outlet, the annular conveying pipe aligns with the grinding roller set, and the large ice blocks are obliquely conveyed to the grinding roller set through the sorting grid assemblies and output from the first pipeline after being crushed.

Optionally, the screening and discharging mechanism further includes a pneumatic auxiliary structure, the pneumatic auxiliary structure includes a centrifugal fan disposed on an outer side of the annular conveying pipe and two sets of pneumatic pipes connected to the centrifugal fan, the two sets of pneumatic pipes are inserted into two ends of the annular conveying pipe, and the two sets of pneumatic pipes are oriented respectively parallel to conveying directions of the annular conveying pipe for outputting the ice blocks in the two operational modes.

DETAILED DESCRIPTION

In the description of the present application, it should be understood that directional or positional relationships indicated by terms such as "center", "longitudinal", "transverse", "length", "width", "thickness", "upper", "lower", "front", "rear", "left", "right", "vertical", "horizontal", "top", "bottom", "inner", "outer", "clockwise", "anticlockwise", "axial", "radial" and "circumferential" are directional or positional relationships based on the accompanying drawings, are merely intended to facilitate describing the present application and simplifying the description, rather than to indicate or imply that the appointed device or element has to be located in a specific direction or structured and operated in the specific direction. Embodiments disclosed in the present application can be set according to different directions, and therefore, these terms indicating directions are merely used as descriptions, and should not be regarded as limitations, for example, "upper" and "lower" are not necessarily limited as directions that are opposite from or consistent to a gravity direction. In addition, the features defined as "first" and "second" may explicitly or implicitly include one or more of the features.

The present application will be further described in detail below in conjunction with the accompanying drawing.

Embodiment 1

Figure 1:
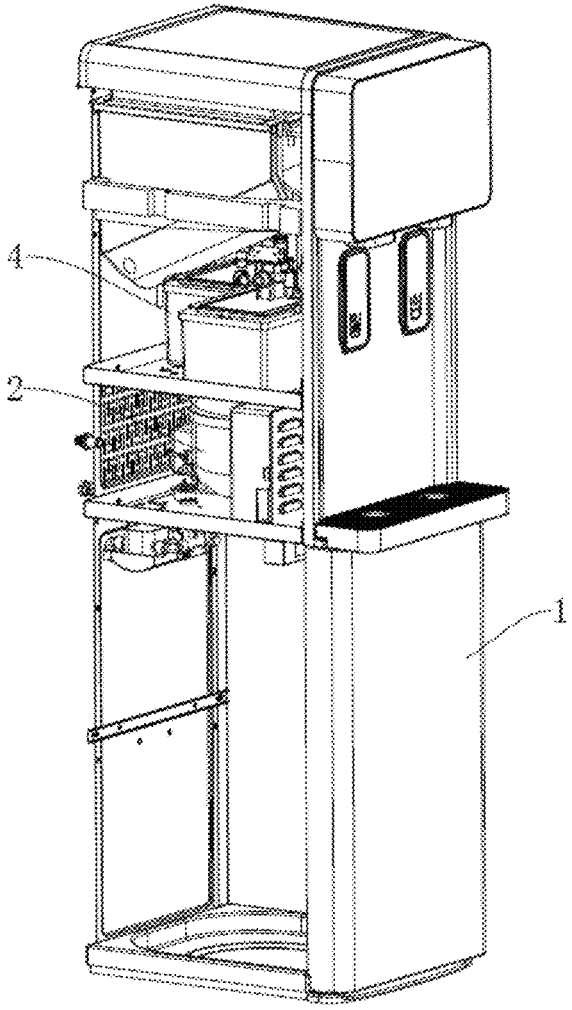
FIG. 1 is a schematic diagram of an overall structure of an ice making water dispenser in Embodiment 1.
Figure 2:
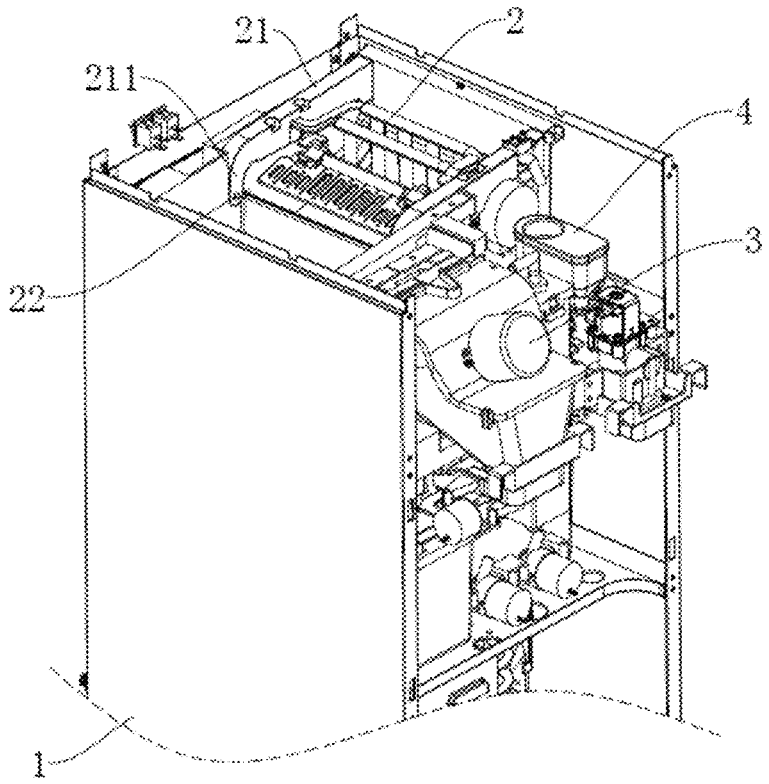
FIG. 2 is a schematic structural diagram of a portion of the ice making water dispenser in Embodiment 1.
Figure 3:
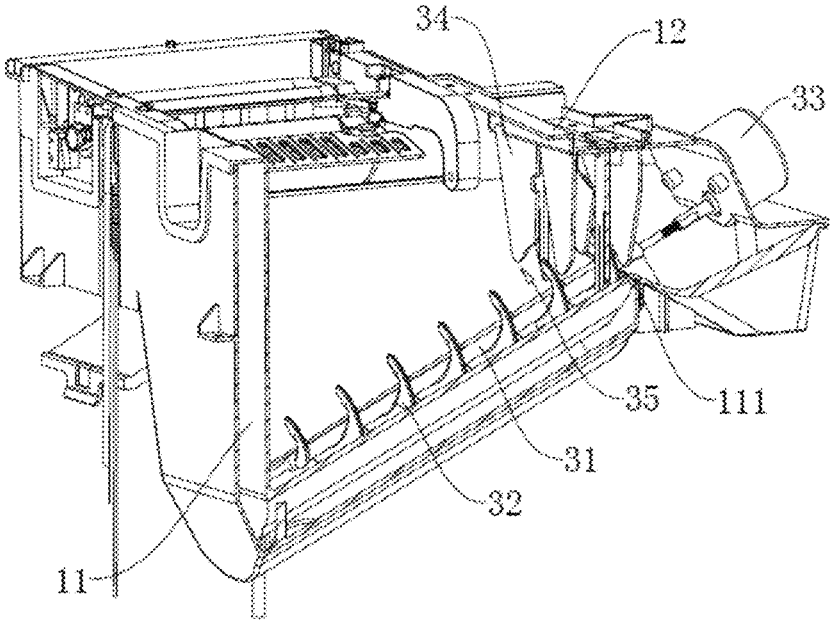
FIG. 3 is a schematic structural diagram of an ice conveying mechanism in Embodiment 1.
Figure 4:
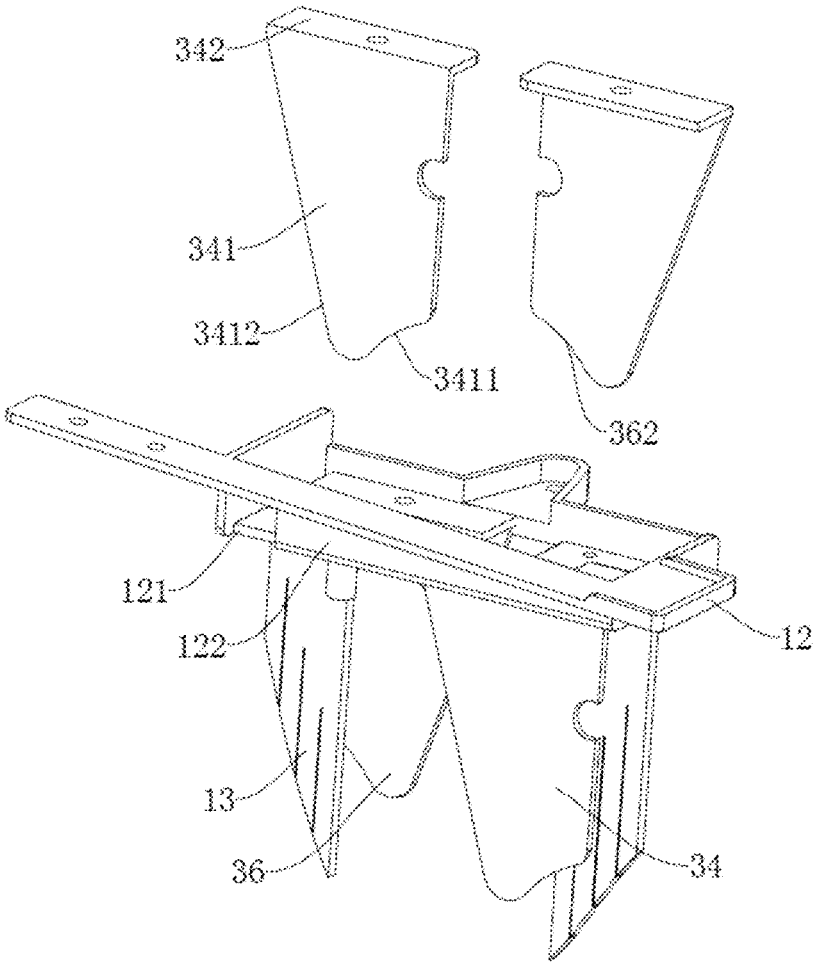
FIG. 4 is a schematic exploded view of a flexible baffle in Embodiment 1.
Figure 5:
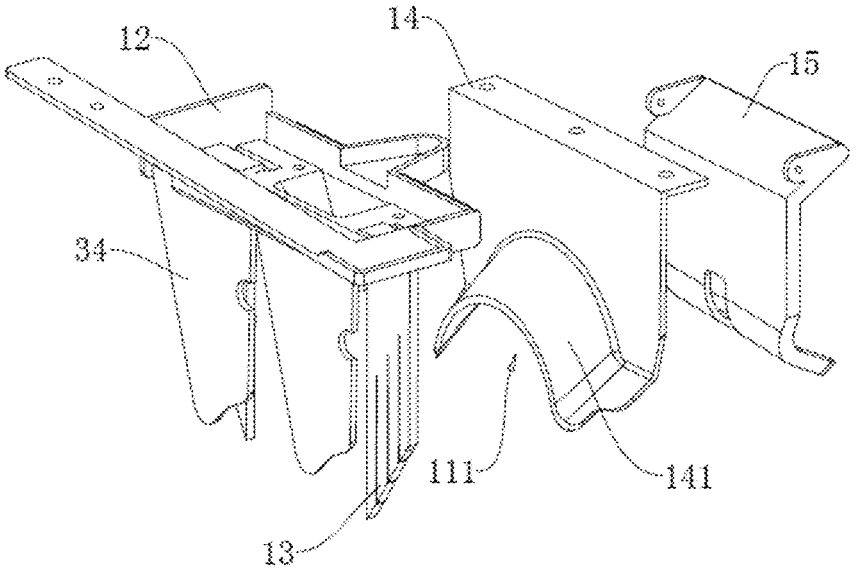
FIG. 5 is a schematic structural diagram of an ice making water dispenser in Embodiment 2.

Referring to FIG. 1, an embodiment of the present application provides an ice making water dispenser, including an ice making shell 1 which may be a rectangular shell arranged vertically. The ice making shell 1 is internally provided with an ice making mechanism 2 for preparing ice blocks, an ice conveying mechanism 3 for conveying the ice blocks and a water dispensing mechanism 4 for making hot water and cold water.

The ice making mechanism 2 is consistent with a cylindrical ice making structure in the prior art, and includes an evaporator, a condenser, a compressor and a storage tank 21. The ice making shell 1 is provided with an ice storage shell 11 for mounting an ice conveying shell and communicating with the storage tank 21. An ice storage chamber arranged obliquely is disposed in the ice storage shell 11, and the storage tank 21 corresponds to an inclined low end of the ice storage chamber. Two opposite sides of the storage tank 21 are provided with extension ends 211 extending to the top of the ice storage shell 11, and the storage tank 21 is mounted with an infrared sensor 22 for sensing the ice blocks at one of the extension ends 211. When it is detected by the infrared sensor 22 that the ice blocks in the ice storage shell 11 are accumulated to a certain height, the ice making mechanism 2 stops making the ice blocks.

The ice conveying mechanism 3 includes an ice conveying screw 31 rotatably mounted on the ice storage shell 11, ice conveying blades 32 fixedly mounted on the ice conveying screw 31 and an ice conveying driving part 33 for driving the ice conveying screw 31 to rotate. The ice conveying screw 31 is arranged obliquely with an inclination angle consistent with that of the ice storage chamber, and the ice conveying driving part 33 is a rotating motor fixed to the ice making shell 1. After the rotating motor is started, the ice blocks in the ice storage shell 11 are conveyed obliquely and upwards from the bottom to an inclined top end of the ice storage shell 11, and the top of the ice storage shell 11 is provided with an ice outlet 111 for outputting the ice blocks.

In order to reduce the probability that the ice blocks are blocked in the ice outlet 111, the ice conveying mechanism 3 is provided with baffles on a side close to the ice outlet 111. Conveying gaps 35 allowing small ice blocks to pass are formed between the baffles and the ice conveying screw 31, and large ice blocks are blocked by the baffles, so that the ice blocks in the ice outlet 111 are conveyed more smoothly.

In the present application, the ice blocks made by the ice making mechanism 2 are poured into the ice storage shell 11 and conveyed by the ice conveying mechanism along the ice conveying screw 31. By disposing the baffles at the ice outlet 111, a certain resistance can be provided when the large ice blocks pass, while the small ice blocks can be conveyed to the ice outlet 111 by the ice conveying blades 32, so that the ice blocks blocked at the ice outlet 111 can be reduced. By adjusting the size of each of the conveying gaps, the sizes of the ice blocks passing therethrough can be controlled, and thus demands of different users for the ice blocks are better satisfied.

In the present embodiment, the baffles may be configured as flexible baffles 34. A mounting base 12 for mounting the flexible baffles 34 is disposed on a side, provided with the ice outlet 111, of the ice storage shell 11. The mounting base 12 is a rectangular plate body erected on the ice storage shell 11 as a whole, and is fixedly connected with the ice storage shell 11 by using bolts. In the present embodiment, the ice conveying mechanism 3 includes two sets of flexible baffles 34 that are spaced in a direction opposite to a conveying direction of the ice blocks. The flexible baffles 34 have elastic deformability, after conveying the ice blocks is stopped, the deformation of the flexible baffles 34 is restored to push the large ice blocks to be away from the ice outlet 111, thereby combing the ice blocks and further relieving the blocking of the ice blocks.

Each of the flexible baffles 34 has an L-shaped section and includes an elastic portion 341 and a mounting portion 342, and the mounting base 12 is provided with a splicing through groove 121 passing through end surfaces on two sides and allowing the elastic portion 341 to be inserted. The elastic portion 341 of the flexible baffle 34 passes through the splicing through groove 121 so that the mounting portion 342 abuts against the top of the mounting base 12, and the flexible baffle 34 and the mounting base 12 are fixed by using screws. A limiting baffle 122 is further integrally disposed on a side, away from the ice outlet 111, of the mounting base 12, and the limiting baffle 122 provides support for the elastic portion 341 to enhance the non-deformability of the flexible baffle 34 and facilitate the restoration of the deformed flexible baffle 34. By disposing the limiting baffle 122, the excessive deformation of the flexible baffles 34 can be limited, so that the flexible baffles 34 are more stable when being stressed.

The elastic portion 341 is provided with a first cutting surface 3411 on a bottom thereof facing the ice conveying screw 31, and the elastic portion 341 is provided with a first inclined surface 3412 on a side wall thereof. The first cutting surface 3411 is configured as an inward concave arc surface, with inward concave directions of the first cutting surfaces 3411 of the two sets of flexible baffles 34 oriented consistently. By disposing the first cutting surface 3411, when being axially conveyed to abut against the flexible baffle 34, the ice blocks are simultaneously subjected to an axial thrust force and a radial shearing force from the first cutting surface to the large ice blocks. In this way, the large ice blocks are progressively deformed and crushed into a plurality of small ice blocks, which greatly relieves the accumulation of the large ice blocks and improves the conveying smoothness of the ice blocks at the ice outlet 111.

The mounting base 12 is fixedly spliced with two sets of guide baffles 13 between the flexible baffles 34 and an ice outlet plate 14. The two sets of guide baffles 13 are respectively located on two opposite side walls of the ice storage shell 11, and two sides of the ice storage chamber are covered by the guide baffles 13, so that a guide gap allowing the ice blocks to pass is formed between the two sets of guide baffles 13. The width of the guide gap is adapted to that of the ice outlet 111, so that the ice blocks can be accurately conveyed to the ice outlet 111. By disposing the guide baffles 13, the small ice blocks passing through the flexible baffles 34 can be guided to the ice outlet 111, so that the ice conveying efficiency is increased.

The ice conveying mechanism 3 is further provided with two sets of second baffles 36 between the guide baffles 13 and the ice outlet plate 14. The second baffles 36 may also be configured as flexible baffles, and structures and mounting ways of the second baffles 36 are both consistent with those of the flexible baffles 34. Each of the second baffles 36 is provided with a second cutting surface 361 on a bottom plate thereof and a second inclined surface 362 on a side wall thereof. Each of the second cutting surfaces 361 may be configured as an inward concave arc surface and arranged in an inward concave direction staggered with that of corresponding one of the first cutting surfaces 3411, and inclination directions of the second inclined surface 362 and the first inclined surface 3412 are opposite. By disposing the second baffles 36, a dual blocking configuration is formed with the flexible baffles 34, thereby improving the effect of blocking the large ice blocks, and further reducing the probability blockage at the ice outlet 111. Each of the flexible baffles 34 and corresponding one of the second baffles 36 are spaced apart to provide a buffering space for conveying the ice blocks, and thus the ice blocks can be stably conveyed. The second cutting surfaces 361 and the first cutting surfaces 3411 are disposed in an staggered arrangement, creating a certain shearing force for cutting the ice blocks. This staggered shearing forces from the two sets of baffles acting on the ice blocks further enhances the shearing effect.

The ice making water dispenser in the embodiment of the present application is implemented based on a principle that the ice blocks made by the ice making mechanism 2 are poured into the ice storage shell 11; when the ice conveying mechanism 3 is started, the ice blocks are conveyed to the ice outlet 111 under the action of the ice conveying blades 32; the smaller ice blocks directly pass through the conveying gaps 35, while oversized ice blocks are blocked by the flexible baffles 34, which undergoes elastic deformation; as the ice conveying screw 31 continues operation, the oversized ice blocks are deformed and crushed into smaller ice blocks under the action of the cutting surfaces of the flexible baffles 34. This process mitigates persistent accumulation of oversized ice blocks in the ice storage shell 11.

Embodiment 2

In the present embodiment, the mounting base 12 is further fixedly mounted with an ice outlet plate 14 between the flexible baffles 34 and the ice conveying driving part 33, and the ice outlet plate 14 is provided with a semicircular arc plate 141 at bottom thereof. The ice outlet 111 is formed by the semicircular arc plate 141 and a bottom wall of the ice storage shell 11 and configured to guide the output of the ice blocks. In the present embodiment, the mounting base 12 is only mounted with the flexible baffles 34, which are positioned on sides of the guide baffles 13 distal from the ice outlet plate 14.

An anti-cover plate 15 for covering the ice outlet 111 is rotatably mounted on a side, distal from the flexible baffles 34, of the ice outlet plate 14. A connecting shaft 142 rotatably cooperating with the ice outlet plate 14 is disposed on the top of the anti-cover plate 15, and an axis of the connecting shaft 142 is perpendicular to the conveying direction of the ice blocks. The ice blocks push the anti-cover plate 15 to rotatably open under the conveyance of the ice conveying screw 31, so that the ice outlet 111 is in a connected state. The anti-cover plate 15 is further provided with a torsional spring part wound on the connecting shaft 142, so that the anti-cover plate 15 can automatically cover the ice outlet 111 after conveying the ice blocks is stopped. Due to the cooperation of the semicircular arc plate 141 and the anti-cover plate 15, the ice storage shell 11 in a normal storage state can be covered, so that heat dissipation can be reduced; and when the ice blocks are conveyed, the anti-cover plate 15 is rotatably opened under the pushing of the ice blocks, so that the ice blocks can be output to a cup of a user.

Embodiment 3

In the present embodiment, all structures other than structures of the baffles and the addition of a screening and discharging mechanism 5 are kept consistent with those in Embodiment 2.

Figure 6:
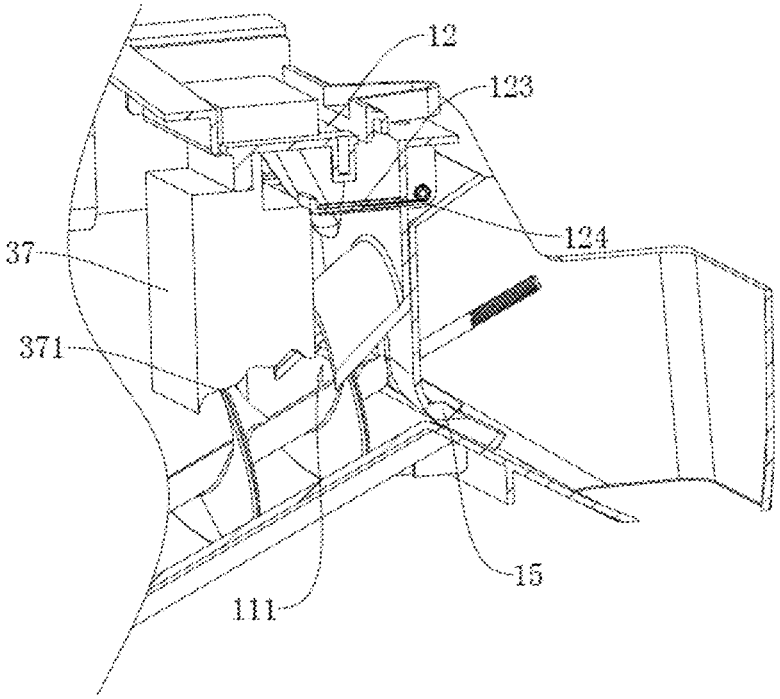
FIG. 6 is a schematic structural diagram of an ice making water dispenser in Embodiment 3.

Referring to FIG. 6, in the present embodiment, the baffles may be configured as wavy baffles 37 uniformly spaced in the conveying direction of the ice blocks. Each of the wavy baffles 37 is provided with a transverse corrugated surface 371 with peaks and troughs uniformly disposed on a sides facing the ice conveying screw 31. The peaks and the troughs are arranged in an undulation direction perpendicular to the ice conveying screw 31. The ice blocks bear periodic pressures from the wavy baffles 37 in the conveying process, so that the large ice blocks are blocked and crushed at the peaks and then pass through the troughs. As the wavy baffles, the baffles have higher structural strength than the flexible baffles, and the ice blocks bear the periodic pressures in the conveying process, so that the large ice blocks may be crushed into small ice blocks, which relieves the situation that the large ice blocks are accumulated.

The wavy baffles 37 on a side close to the ice outlet plate 14 are slidably mounted on the mounting base 12, and a sliding chute 123 for arranging the wavy baffles 37 is disposed in the mounting base 12. The mounting base 12 is mounted with a driving rack 124 limited in the sliding chute 123, the driving rack 124 has a first end abutting against and cooperating with a wavy baffle 37 and a second end extending to the bottom of the connecting shaft 142. The connecting shaft 142 is provided with a tooth surface cooperating with the driving rack 124. When the ice blocks abut against the wavy baffles 37, the wavy baffles 37 are driven to move to the ice outlet 111, and the driving rack 124 is driven by the wavy baffles 37 to slide in the sliding chute 123, so that the anti-cover plate 15 is driven to be opened outward, which is convenient for the small ice blocks to directly pass through the ice outlet 111. In this way, the rotation efficiency of the anti-cover plate 15 is increased and the conveying efficiency of the ice blocks is increased.

Figure 7:
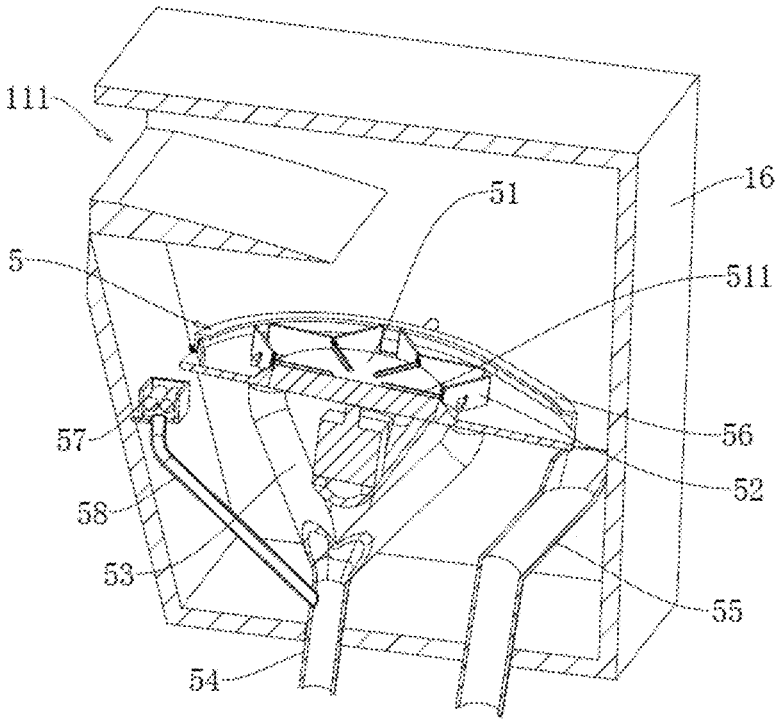
FIG. 7 is a schematic structural diagram of an output shell in Embodiment 3.
Figure 8:
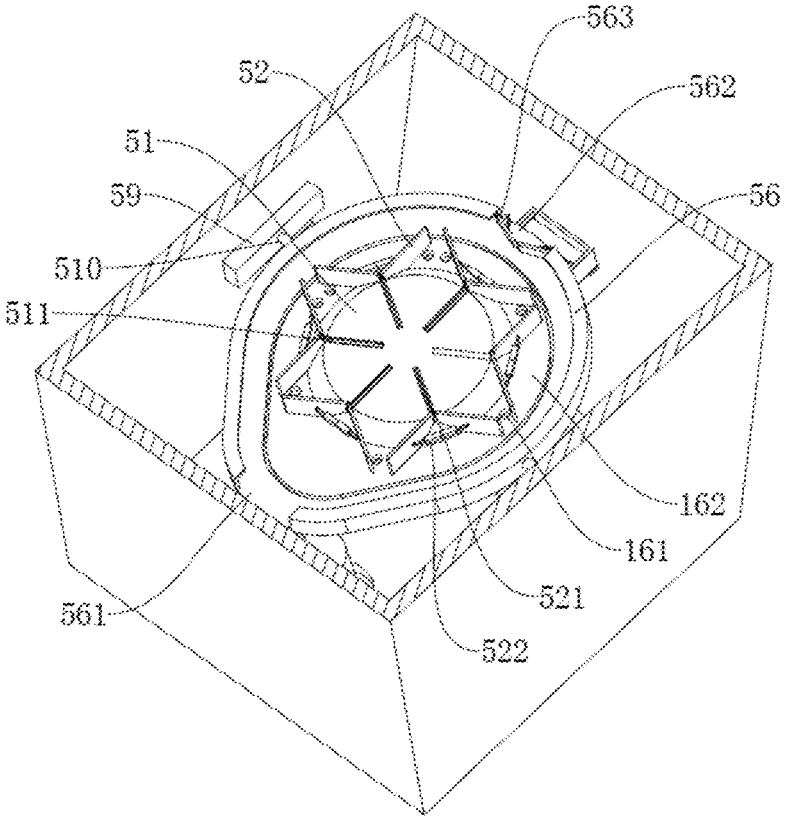
FIG. 8 is a schematic diagram of a planar structure of the output shell in Embodiment 3.

Referring to FIG. 7 and FIG. 8, in order to reduce the probability that the ice blocks are blocked at the ice outlet 111 and further increase the efficiency of conveying the ice blocks to a cup of a user, the ice conveying mechanism 3 is further provided with a screening and discharging mechanism 5 on the top of the ice storage shell 11. The ice conveying mechanism 3 is provided with an output shell 16 for mounting the screening and discharging mechanism 5. The output shell 16 communicates with the ice outlet 111. The ice blocks passing through the ice outlet 111 are output to the outside by the output shell 16, and the screening and discharging mechanism 5 is disposed in the output shell 16 to further screen the ice blocks, so that the adaption situation is improved.

The screening and discharging mechanism 5 includes a sorting plate 51 rotatably mounted on the output shell 16, sorting grid assemblies 52 disposed on a periphery of the sorting plate and a recycling and crushing structure. The sorting plate 51 may be configured as a round plate arranged horizontally, and the sorting plate 51 may be driven to rotate by means of a rotating motor disposed on the bottom of the sorting plate 51. A plurality of sets of flow guide ribs 511 arranged radially along a central axis of the sorting plate 51 are integrally disposed on a surface of the sorting plate 51. A plurality of ice guide regions arranged circumferentially are formed on the sorting plate 51 by means of the flow guide ribs 511, and ice blocks in the ice guide regions move to the periphery under the action of a centrifugal force. By disposing the screening and discharging mechanism, the ice blocks can be screened to meet water dispensing demands of different users.

A plurality of sorting grid assemblies 52 are uniformly spaced on an outer side of the sorting plate 51 along an axis of the sorting plate 51, each sorting grid assembly 52 includes two sorting grids distributed in a shape like a horn, and has a large-opening side oriented toward the axis of the sorting plate 51. The output shell 16 is provided with an annular plate 162 for mounting the sorting grid assemblies 52, first through holes 161 passing through end surfaces on two sides are formed in the annular plate 162, and the first through holes 161 are only in sizes allowing the small ice blocks to pass. A width of an opening in an end of each of the sorting grid assemblies 52 distal from the sorting plate 51 is greater than the internal diameter of corresponding one of the first through holes 161, so that the large ice blocks can pass through the sorting grids. By disposing the sorting grid assemblies 52, an effect of initially blocking the large ice blocks can be achieved; and when there are more large ice blocks in the sorting grid assemblies 52, the sorting grids are gradually opened outward under the pressure action of the ice blocks, so that the large ice blocks can be conveyed to the recycling and crushing structure.

The output shell 16 is correspondingly mounted with a plurality of flow guide slideways 53 below the first through holes 161, ends of the plurality of flow guide slideways 53 are converged to a first pipeline 54 through which the ice blocks are conveyed to the outside of the ice making shell 1. The first pipeline 54 has a telescopically nested multi-segment tubular structure with spring-actuated extension/retraction capability, so as to adapt to cups with different heights, and thus splash caused by ice block falling may be reduced.

Based on the above-mentioned structure, the ice blocks fall on the sorting plate 51 via the ice outlet 111, and the sorting plate 51 rotates to drive the large and small ice blocks to move to the periphery. The small ice blocks penetrate through the first through holes 161 along the flow guide ribs 511 and then directly conveyed to the outside of the shell via flow guide slideways 53, while the large ice blocks cannot directly pass through the first through holes 161, but can pass through the sorting grids and are further crushed by the recycling and crushing structure.

In order to increase the conveying efficiency of the oversized ice blocks, hinges 521 cooperating with the annular plate 162 in a hinged way are disposed at ends, close to the sorting plate 51, of the sorting grids, and the sorting grids of the adjacent sorting grid assemblies 52 share the same hinge 521. A spring telescopic rods 522 is hingedly mounted on a sidewall of each of the sorting grids distal from the corresponding first through hole 161, with its opposing end fixedly secured to an adjacent sorting grid assembly 52. When more ice blocks are accumulated at small-opening ends of the sorting grids, ice blocks located at outer sides drive the sorting grids to be opened outward under the pushing of ice blocks at inner sides, so that the openings of the sorting grids are gradually enlarged.

The ice making shell 1 is rotatably mounted with an annular conveying pipe 56 at outer sides of the sorting grids, and the annular conveying pipe 56 is wound on an outer side of the annular plate 162. In a normal state, the annular conveying pipe 56 is arranged downwards and obliquely in a direction away from the ice outlet 111 as a whole. A second through hole 561 is formed in an inclined low end of the annular conveying pipe 56, and a second pipeline 55 corresponding to the second through hole 561 is mounted on the output shell 16. The second pipeline 55 has the same structure as the first pipeline 54 and is used for conveying the large ice blocks to outside of the ice making shell 1 so as to meet user's demands on the ice blocks.

A third through hole 562 is formed in an inclined top end of the annular conveying pipe 56, and a cover plate 563 is rotatably disposed on the third through hole 562. The cover plate 563 includes two plate bodies arranged in a shape like V, and the plate bodies and the annular conveying pipe 56 are further connected with spring parts. An opening of the cover plate 563 is located in a side away from the sorting plate 51. When the annular conveying pipe 56 is in a normal inclined state, the third through hole 562 is closed by the cover plate 563, and a rotating motor for driving the annular conveying pipe 56 to rotate is disposed outside the output shell 16. A connecting structure which is in spliced cooperation is disposed between the annular conveying pipe 56 and the motor for controlling the sorting plate 51 to rotate, and only when the annular conveying pipe 56 is in spliced cooperation with the motor for controlling the sorting plate 51 to rotate, an operator can control the annular conveying pipe 56 to rotate to achieve the simultaneous inclined rotation of the annular conveying pipe 56, the sorting plate 51 and the annular plate 162.

When an inclination direction of the annular conveying pipe 56 is adjusted by a user, the ice blocks in the annular conveying pipe 56 move to the third through hole 562, and the cover plate 563 is opened outwards in a direction away from the sorting plate 51 under the pushing action of the ice blocks, so that the ice blocks can be output from the third through hole 562.

The output shell 16 is correspondingly provided with a grinding roller set 57 and a recovery slideway 58 at an outlet of the third through hole 562. The grinding roller set 57 includes two sets of grinding rollers rotatably mounted and driven by a motor. The recovery slideway 58 is located below the grinding roller set 57 and is used for receiving crushed ice blocks, and the other end of the recovery slideway 58 communicates to the first pipeline 54.

In a normal state, the annular conveying pipe 56 is in a state that the second through hole 561 is inclined downwards. At this time, the large ice blocks can be directly output from the second pipeline 55, and the small ice blocks are output from the first pipeline 54. When the annular conveying pipe 56 contains excessive large ice blocks while small ice blocks are required by the user, the large ice blocks in the annular conveying pipe 56 are preferably used, and an inclination direction of the annular conveying pipe 56 may be adjusted by a user, so that all of the large ice blocks slide out of the third through hole 562 and then be deformed and cracked under the action of the grinding roller set 57, and finally output via the first pipeline 54.

By means of the two conveying ways of the annular conveying pipe 56, a user can adjust the inclination state of the annular conveying pipe 56 according to user's demands on the ice blocks, so that the large ice blocks or the small ice blocks are obtained from the output shell 16.

In order to increase the conveying efficiency of the ice blocks in the annular conveying pipe 56, the output shell 16 is further provided with a pneumatic auxiliary structure on an outer side of the annular conveying pipe 56, and the pneumatic auxiliary structure includes centrifugal fans 59 and pneumatic pipes 510. The pneumatic pipes 510 are respectively inserted to the annular conveying pipe 56, so that the pneumatic auxiliary structure can blow air according to different output situations of the annular conveying pipe 56. By disposing the pneumatic auxiliary structure, the conveying efficiency of the ice blocks in the annular conveying pipe 56 can be further increased, and flake ice in the annular conveying pipe 56 can be blown to the pipeline.

The above descriptions are all preferred embodiments of the present application, and are not intended to hereby limit the protective scope of the present application. Therefore, all equivalent variations made according to the structure, shape and principle of the present application shall fall within the protective scope of the present application.

DESCRIPTION FOR REFERENCE NUMERALS 1, ice making shell;
11, ice storage shell;
111, ice outlet;
12, mounting base;
121, splicing through groove;
122, limiting baffle;
123, sliding chute;
124, driving rack;
13, guide baffle;
14, ice outlet plate;
141, semicircular arc plate;
142, connecting shaft;
15, anti-cover plate;
16, output shell;
161, first through hole;
162, annular plate;
2, ice making mechanism;
21, storage tank;
211, extension end;
22, infrared sensor;
3, ice conveying mechanism;
31, ice conveying screw;
32, ice conveying blade;
33, ice conveying driving part;
34, flexible baffle;
341, elastic portion;
3411, first cutting surface;

3412, first inclined surface;
342, mounting portion;
35, conveying gap;
36, second baffle;
361, second cutting surface;
362, second inclined surface;
37, wavy baffle;
371, transverse corrugated surface;
4, water dispensing mechanism;
5, screening and discharging mechanism;
51, sorting plate;
511, flow guide rib;
52, sorting grid assembly;
521, hinge;
522, spring telescopic rod;
53, flow guide slideway;
54, first pipeline;
55, second pipeline;
56, annular conveying pipe;
561, second through hole;
562, third through hole;
563, cover plate;
57, grinding roller set;
58, recovery slideway;
59, centrifugal fan;
510, pneumatic pipe.

What is claimed is:

1. An ice making water dispenser, comprising an ice making shell in which an ice making mechanism for preparing ice blocks, an ice conveying mechanism for conveying the ice blocks and a water dispensing mechanism are disposed, the ice making shell being provided with an ice storage shell for storing the ice blocks, the ice conveying mechanism comprising an ice conveying screw rotatably mounted in the ice storage shell, ice conveying blades disposed on the ice conveying screw and an ice conveying driving part for driving the ice conveying screw to rotate, and the ice storage shell being provided with an ice outlet at one end of the ice conveying screw; wherein the ice conveying mechanism is provided with baffles at the ice outlet, and conveying gaps allowing the ice blocks to pass are formed between the baffles and the ice conveying screw, wherein the baffles are flexible baffles, the ice conveying mechanism comprises at least two flexible baffles, and adjacent flexible baffles of the at least two flexible baffles are arranged in a direction perpendicular to a conveying direction of the ice blocks.

2. The ice making water dispenser according to claim 1, wherein each of the at least two flexible baffles comprises an elastic portion and a mounting portion, the ice storage shell is provided with a mounting base for mounting the at least two flexible baffles, the mounting base is provided with a splicing through groove allowing the elastic portion to be inserted into the mounting base, and a limiting baffle abutting against the elastic portion is disposed on a side, provided with the splicing through groove, of the mounting base.

3. The ice making water dispenser according to claim 2, wherein the elastic portion is provided with a first cutting surface which is an inward concave arc surface at an end facing the ice conveying screw, and the adjacent flexible baffles of the at least two flexible baffles have respective first cutting surfaces in inward concave directions parallel to each other.

4. The ice making water dispenser according to claim 3, wherein the mounting base is provided with two guide baffles on sides, close to the ice outlet, of the at least two flexible baffles, side walls of the two guide baffles abut against two opposite side walls of the ice storage shell, and a guide gap corresponding to the ice outlet is formed between the two guide baffles.

5. The ice making water dispenser according to claim 4, wherein the mounting base is provided with an ice outlet plate on a side of the mounting base close to the ice conveying driving part, the ice outlet plate is provided with a semicircular arc plate at a bottom, the ice outlet is defined by the semicircular arc plate and a bottom wall of the ice storage shell, and the ice storage shell is rotatably mounted with an anti-cover plate for covering the ice outlet on a side of the ice outlet plate distal from the at least two flexible baffles.

6. The ice making water dispenser according to claim 4, wherein the ice conveying mechanism further comprises second baffles disposed between the two guide baffles and the ice outlet.

7. The ice making water dispenser according to claim 6, wherein each of the second baffles is provided with a second cutting surface, and the second cutting surface is arranged in the inward concave direction staggered with that of the first cutting surface.

8. The ice making water dispenser according to claim 1, wherein the ice storage shell is provided with an output shell for conveying the ice blocks to an outside of the ice making water dispenser, the output shell communicates with the ice outlet, and a screening and discharging mechanism is disposed in the output shell.

9. The ice making water dispenser according to claim 8, wherein the screening and discharging mechanism comprises a sorting plate rotatably mounted on the output shell, sorting grid assemblies disposed on a periphery of the sorting plate and a recycling and crushing structure, wherein the sorting plate is configured as a conical turnplate, a plurality of sets of flow guide ribs arranged radially along an axis of the sorting plate are disposed on a surface of the sorting plate, the output shell is provided with first through holes allowing a first portion of the ice blocks to pass between each of the sorting grid assemblies and the sorting plate, a plurality of flow guide slideways corresponding to the first through holes are disposed in the output shell, and the plurality of flow guide slideways communicate with a first pipeline for output.

10. The ice making water dispenser according to claim 9, wherein the sorting grid assemblies are circumferentially spaced along the axis of the sorting plate, each of the sorting grid assemblies comprises two sorting grids arranged obliquely and has a large-opening side oriented toward the sorting plate, each of the sorting grids is disposed on the output shell by a hinge, two adjacent sorting grids of the sorting grid assemblies are connected by a telescopic rod, the sorting grids are configured to block a second portion of the ice blocks, and the second portion of the ice blocks drive the sorting grids to swing outward, thereby increasing an opening size of each of the sorting grid assemblies on a side distal from the sorting plate.

11. The ice making water dispenser according to claim 9, wherein the recycling and crushing structure comprises an annular conveying pipe rotatably disposed at a periphery of the sorting plate, a grinding roller set disposed on a first end of the annular conveying pipe and a second pipeline disposed on a second end of the annular conveying pipe, wherein the annular conveying pipe is provided with a second through hole corresponding to the second pipeline at the first end and a third through hole corresponding to the grinding roller set at the second end, and the grinding roller set communicates with the first pipeline; and wherein the annular conveying pipe has two operational modes: when the annular conveying pipe is inclined downward away from the ice outlet, the annular conveying pipe aligns with the second pipeline, and a second portion of the ice blocks are obliquely conveyed to the second pipeline through the sorting grid assemblies; and when the annular conveying pipe is inclined downward close to the ice outlet, the annular conveying pipe aligns with the grinding roller set, and the second portion of the ice blocks are obliquely conveyed to the grinding roller set through the sorting grid assemblies and output from the first pipeline after being crushed.

12. The ice making water dispenser according to claim 11, wherein the screening and discharging mechanism further comprises a pneumatic auxiliary structure comprising centrifugal fans disposed on an outer side of the annular conveying pipe and two sets of pneumatic pipes connected to the centrifugal fans, the two sets of pneumatic pipes are inserted into two ends of the annular conveying pipe, and the two sets of pneumatic pipes are oriented respectively parallel to conveying directions of the annular conveying pipe for outputting the ice blocks in the two operational modes.

13. An ice making water dispenser, comprising an ice making shell in which an ice making mechanism for preparing ice blocks, an ice conveying mechanism for conveying the ice blocks and a water dispensing mechanism are disposed, the ice making shell being provided with an ice storage shell for storing the ice blocks, the ice conveying mechanism comprising an ice conveying screw rotatably mounted in the ice storage shell, ice conveying blades disposed on the ice conveying screw and an ice conveying driving part for driving the ice conveying screw to rotate, and the ice storage shell being provided with an ice outlet at one end of the ice conveying screw; wherein the ice conveying mechanism is provided with baffles at the ice outlet, and conveying gaps allowing the ice blocks to pass are formed between the baffles and the ice conveying screw, wherein one of the baffles is configured as a wavy baffle, the wavy baffle is provided with a transverse corrugated surface, the transverse corrugated surface is provided with peaks and troughs on a side of the wavy baffle facing the ice conveying screw, and the peaks and troughs are arranged in an undulation direction perpendicular to a conveying direction of the ice blocks.

14. The ice making water dispenser according to claim 13, wherein the wavy baffle is slidably mounted on a mounting base of the ice storage shell, a sliding chute is formed in the mounting base, a driving rack is limit-mounted in the sliding chute, the ice storage shell is rotatably mounted with an anti-cover plate for covering the ice outlet on a side of an ice outlet plate of the mounting base distal from the wavy baffle, the driving rack has a first end abutting against and cooperating with the wavy baffle, the anti-cover plate is provided with a tooth surface cooperating with a second end of the driving rack, and when the ice blocks are conveyed, the wavy baffle is driven to horizontally slide along the sliding chute, so that the driving rack actuates the anti-cover plate to pivot outwardly, thereby placing the ice outlet in an open state.

* * * * *